United States Patent [19]

Hutchinson

[11] Patent Number: 4,936,065

[45] Date of Patent: Jun. 26, 1990

[54] NON-FOLDABLE COMPOSITE ATTACHMENT SYSTEM

[75] Inventor: Douglas Hutchinson, St. Charles, Mo.

[73] Assignee: Dunmon Corporation, St. Louis, Mo.

[21] Appl. No.: 297,056

[22] Filed: Jan. 17, 1989

[51] Int. Cl.[5] ..... E04C 1/24

[52] U.S. Cl. ..... 52/235; 52/460; 52/461; 52/465; 52/747

[58] Field of Search ..... 52/235, 471, 463, 462, 52/482, 747, 461, 465

[56] References Cited

U.S. PATENT DOCUMENTS

| | | | |
|---|---|---|---|
| 2,073,277 | 3/1937 | Hohl | 52/475 |
| 2,073,278 | 3/1937 | Hohl | 52/395 |
| 3,071,215 | 1/1963 | Gall | 52/235 |
| 3,199,258 | 8/1965 | Jentoft et al. | 52/282 |
| 3,374,590 | 3/1968 | Kessler | 52/717.1 |
| 3,548,557 | 1/1970 | Downing, Jr. | 52/461 |
| 3,553,915 | 1/1971 | Passovoy | 52/241 |
| 3,868,802 | 3/1975 | Schubach | 52/462 |
| 4,114,330 | 9/1978 | Sukolics | 52/460 |
| 4,151,691 | 5/1979 | Wendt | 52/242 |
| 4,344,267 | 8/1982 | Sukolics | 52/781 |
| 4,452,029 | 6/1984 | Sukolics | 52/747 |

*Primary Examiner*—James L. Ridgill, Jr.
*Attorney, Agent, or Firm*—Bachman & LaPointe

[57] ABSTRACT

The present invention relates to an attachment system for forming a substantially planar wall structure, intermediate and end connectors to be used in the system, and a method of assembling the system to form the desired wall structure. The intermediate connector joins adjacent ones of the wall panels and comprises two panel retention members in an overlapping relationship. Each panel retention member has a base portion, a web portion, and two substantially parallel, noncoextensive, integral flanges defining a recess for receiving an edge portion of a wall panel.

23 Claims, 2 Drawing Sheets

NON-FOLDABLE COMPOSITE ATTACHMENT SYSTEM

BACKGROUND OF THE INVENTION

The present invention relates to an attachment system for forming a substantially planar wall structure, a connector to be used in the system, and a method of assembling the system to form the wall structure.

A variety of different techniques and systems are employed to form interior and exterior walls. Typically, the walls are formed by a number of individual panel members joined together by connector(s) mounted to a support structure. The panel members may be formed from metallic materials such as aluminum, thermoplastic materials, glass, or composites. The connectors vary depending upon the type of wall to be constructed and the type of support structure to which they are mounted. The following U.S. patents illustrate some of the various types of connectors and wall systems known in the art.

U.S. Pat. No. 3,071,215 to Gall relates to a system for forming an exterior curtain wall from a plurality of pre-assembled units, sections or panels. The panels are located and supported in position by a series of column members or side rails and a series of horizontal beam members including a top rail, a bottom rail and one or more intermediate rails. Hanger plates are used to join each side rail to a mounting member. Each side rail includes a base portion and a channel for receiving an edge portion of a panel. The channel is formed by a pair of horizontally spaced legs extending from the base portion and a pair of inturned flanges. The top, bottom and intermediate rails employ a similar construction to define a channel or channels for receiving an edge portion of a panel.

U.S. Pat. No. 3,199,258 to Jentoft et al. illustrates a vertical mullion support to be used in a system for constructing a wall from a plurality of panels where the central portion of each panel is inwardly bowed. The vertical mullion support comprises a base portion, a central web construction extending from the base portion, and an outboard end formed by a pair of spaced apart, diverging sidewalls. Each sidewall includes a pair of inwardly sloped flanges defining a panel edge receiving slot. The inwardly sloped flanges cause the panels to assume the desired inwardly bowed configuration. The support further comprises a cap member which is recived within a longitudinal opening defined by the spaced apart sidewalls. A groove is provided in each sidewall for receiving a locking member on the cap.

U.S. Pat. Nos. 3,548,557 to Downing, Jr. and 3,553,915 to Passovoy illustrate connectors for forming interior partition walls. In the Downing, Jr. system, each panel is provided with a web having a down turned end. The supporting studs are each provided with a pair of flanges for abutting against the interior surface of adjacent panels. The flanges each include a finger and a shoulder for engaging the down turned end of the panel web to support the panel. Passovoy joins adjacent panels to a supporting member by snapping a panel retaining clip having a bifurcated receptacle section onto the support member. The panels are held in position by a T-shaped member which has a leg inserted into the receptacle section.

Still other types of panel connectors are illustrated in U.S. Pat. Nos. 4,114,330 to Sukolics and 4,151,691 to Wendt. The Sukolics patent relates to a modular skylight system which employs multi-piece connectors to join adjacent skylight panels. Wendt illustrates a ceiling rail for supporting members used to form a hollow wall partition. The ceiling rail has a base portion and a plurality of downwardly extending flanges for defining panel edge portions receiving channels.

A different type of wall system is illustrated in U.S. Pat. Nos. 4,344,267 and 4,452,029, both to Sukolics, and co-pending, commonly owned, U.S. patent application Ser. Nos. 110,174, filed Oct. 19, 1987, and 110,421, filed Oct. 20, 1987, both to Hutchison. In this system, a panel connecting member is mounted to a support structure. The panel connecting member includes a base portion, a pair of outwardly extending legs and means on each leg for engaging down-turned edge portions of adjacent panel members. The system also includes an insert for insuring positive engagement between the down-turned panel edges and the connector.

Certain aluminum and thermoplastic composite panel materials because of their finish, chrome plating, or brittle paint cannot be folded without damaging or destroying the finish. Therefore, a different type of connector must be used when forming these panels into a wall structure. Ideally, the connector is one which is easy to install and easy to use. Many prior art connectors are often either difficult to install or cumbersome to use.

Accordingly, it is an object of the present invention to provide a system and method for forming a substantially planar wall from a plurality of panel members.

It is a further object of the present invention to provide a connector for use in the above system and method which is easy to install and simple to use.

It is still a further object of the present invention to provide a connector as above which lends itself to use with a wide variety of panels having a wide variety of finishes and with a wide variety of support structures.

These and further objects and advantages will become apparent from the following description wherein like reference numerals depict like elements.

SUMMARY OF THE INVENTION

The foregoing objects and advantages are achieved by the present invention which comprises a system and method for forming a substantially planar wall structure having a plurality of panel members substantially lying in a common plane. The system includes at least one support member, at least two individual panel members and at least one intermediate connector for joining two adjacent panel members. Each intermediate connector comprises two separable panel retention members in an overlapping relationship. The panel retention members each have a base portion with an aperture for receiving a fastener, a web portion extending from the base portion and two spaced apart, substantially parallel, non-coextensive flanges extending from the web portion and defining a recess for receiving an edge portion of a panel member. The intermediate connector may further include a cap for sealing a gap between the web portions of the overlapping panel retention members and means on the web portions for positively engaging the cap. A special end termination connector similar to the intermediate connector is used for end panels.

To erect a wall using using the connectors of the present invention, the connectors are first fastened to the panel members. Thereafter, the connector-panel assemblies are fastened to the support structures. Each connector is first fastened to a respective panel by spraying the walls of the recesses defined by the spaced apart flanges on each connector and the edge portions of the panel to be inserted therein with an adhesive which is then allowed to get tacky. The panel is then inserted into the recesses in the respective connector. Intermediate panels will have two intermediate connectors fastened to opposed edge portions. End panels will have one end inserted into the special end termination connector and the other end into one of the intermediate connectors.

The assembly is installed by: placing a first connector-panel assembly in a desired location and positioning a first panel retention member against a support surface; placing a second connector-panel assembly adjacent the first and placing a second panel retention member in overlapping relationship with the first panel retention member; and passing a fastener such as a screw through the aligned apertures in the base portions of the overlapped panel retention members. End panels are installed by positioning an edge member of the termination connector in a desired location and placing the end panel retention member in overlapping relationship with the edge member and fastening the two members to the support structure.

To insure that each panel is properly sealed, a sealant such as a silicone sealant is inserted between a surface of each panel and an angled edge portion of one of the recess defining flanges. Where a weather seal or an attractive finish is required, a cap may be inserted into the gap in each connector created by the spaced apart web portions.

DETAILED DESCRIPTION

The present invention relates to a system and a method for forming a substantially planar wall. The system comprises at least two panel members, at least one intermediate connector for joining adjacent panel members and a termination connector for receiving end panels. The panel members may be formed from metal, glass, plastic and/or composite materials.

Figure 1:
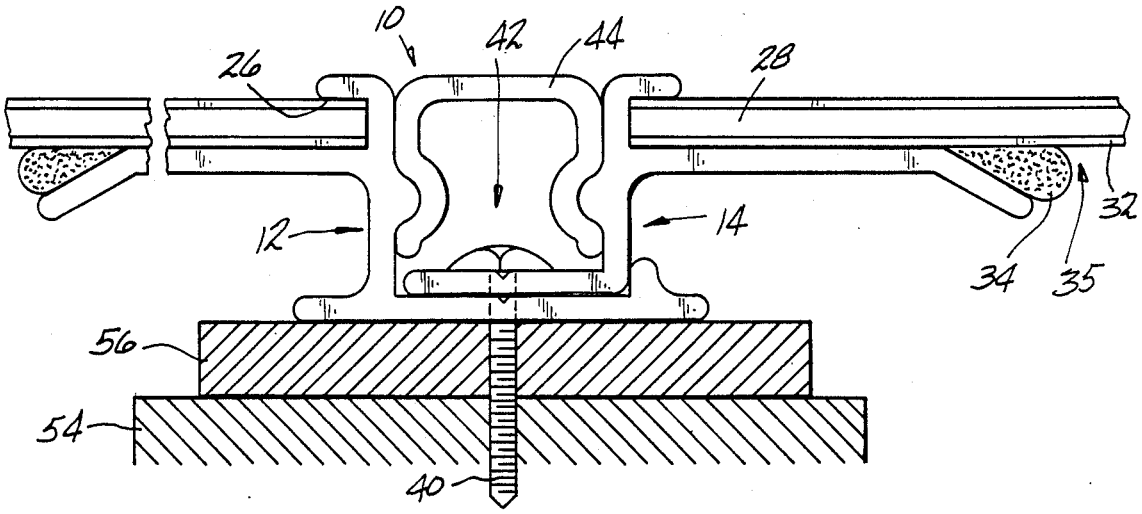
FIG. 1 illustrates a connector in accordance with the present invention.
Figure 2:
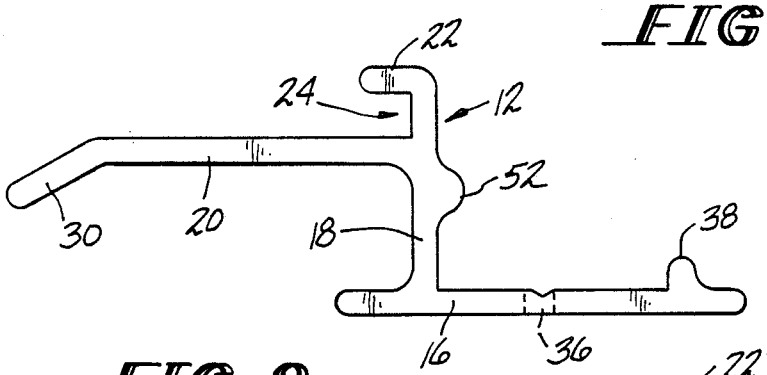
FIG. 2 illustrates one of the panel retention members forming the connector of FIG. 1.

With reference to the figures, an intermediate connector 10 for joining adjacent panels in accordance with the present invention is shown in FIG. 1. The connector 10 comprises a first panel retention member 12 and a second panel retention member 14 in overlapping relationship with the first member. As can be seen from FIG. 2, the first member 12 has a base portion 16, a web portion 18 extending from and substantially perpendicular to the base portion 16, and two spaced apart, integrally formed flanges 20 and 22 extending from and substantially perpendicular to the web portion 18. The flanges 20 and 22 extend substantially parallel to the base portion and to each other and define a recess 24 for receiving an edge portion 26 of a panel member 28. To facilitate assembly of a wall and insertion of the panel into the recess, the flange 22 is substantially shorter than the flange 20.

The longer flange 20 has an angled edge portion 30 for defining with a surface 32 of a panel to be inserted in the recess 24, a space into which a sealant 34 can be inserted. The sealant serves to substantially prevents the entry of moisture, dust and/or other adverse environmental contaminants. The edge portion 30 preferably forms an angle in the range of from about 30° to about 45° with the panel surface 32.

The base portion 16 has an aperture 36 through which a fastener 40 can pass to mount the member 12 to a support structure. The base portion 16 also has a raised stop portion 38 for insuring proper alignment of the second panel retention member 14 when it is placed in its overlapping position.

Figure 3:
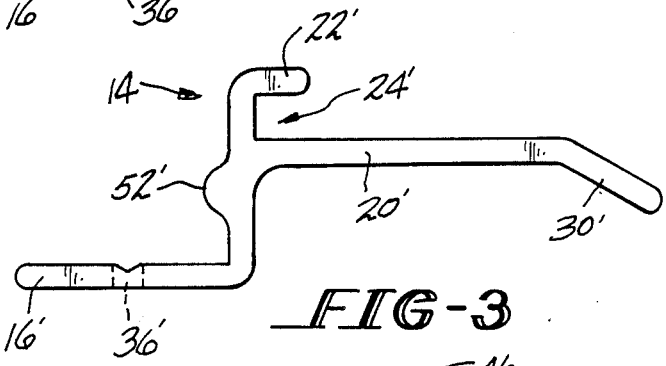
FIG. 3 illustrates the other of the panel retention members forming the connector of FIG. 1.

The second panel retention member 14 as can be seen from FIG. 3 is substantially identical in construction to the first panel retention member. The second member 14 has a base portion 16', a web portion 18' and two spaced apart flanges 20' and 22' defining a panel receiving recess 24'. The base portion 16' also has an aperture 36' through which a fastener 40 can pass. When the panel retention members 12 and 14 are in their overlapped position, the aperture 36' is aligned with the aperture 36.

The base portion 16' is different from the base portion of the first member in two respects. First, it is sized to fit within the space defined by the raised portion 38 and the web portion 18 to insure proper alignment of the members 12 and 14 and the apertures 36 and 36'. Second, it is substantially planar and lacks a raised portion similar to raised stop portion 38.

It should also be noted that the web portion 18' of the second member 14 is shorter than the web portion 18 of the first member. This is necessary to form a wall having panel members which substantially lie in a common plane.

While the panel retention members 12 and 14 may be formed from any desired material, it is preferred that they be formed from a metallic material such as an aluminum extrusion.

When assembled, the spaced apart web portions 18 and 18' define a gap 42 which provides access to the fastener 40. Any suitable means known in the art may be used to seal the gap. For example, a gasket not shown formed from an elastomeric material may be inserted into the gap. Alternatively, a cap 44 may be provided to seal the gap 42. For exterior applications, the cap 44 may serve as a weather seal. For both exterior and interior applications, the cap 44 may alternatively serve as a finishing piece for enhancing the aesthetic appeal of the wall.

Figure 4:
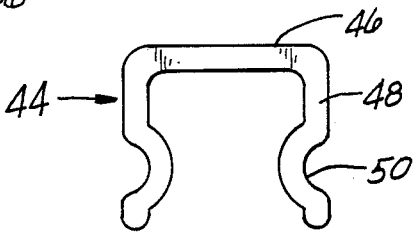
FIG. 4 illustrates a sealing cap to be used with the connector of FIG. 1.
Figure 6:
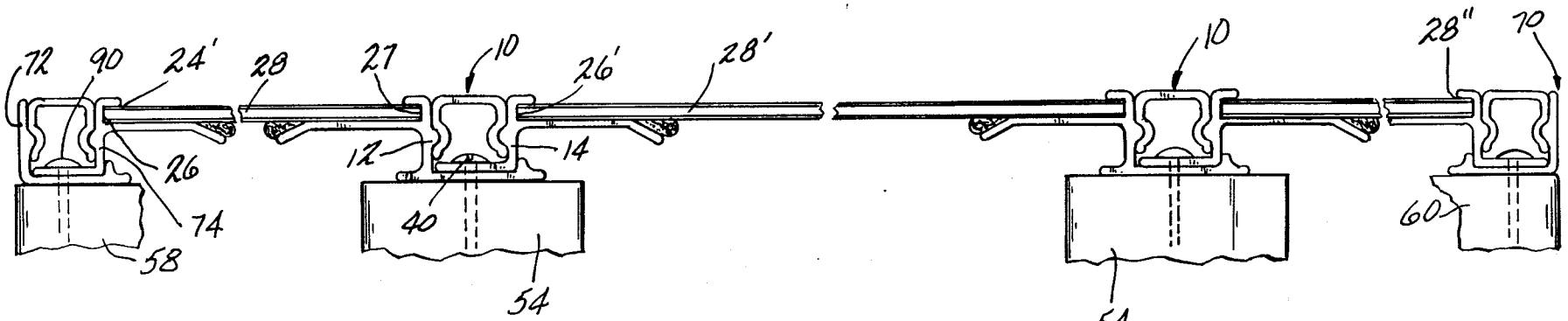
FIG. 6 illustrates a wall formed in accordance with the present invention.

As shown in FIG. 4, the cap 44 has a base portion 46 and two sidewalls 48. Each sidewall 48 is provided with a substantially semi-cylindrical recess 50 for receiving a mating substantially semi-cylindrical portion 52 and 52' on one of the webs 18 and 18'. The recesses 50 and the portions 52 and 52' serve to positively lock the cap 44 to the retention members 12 and 14. The cap 44 may be formed from any suitable metallic or non-metallic material. Preferably, it comprises a strip insert formed from a plastic material.

Figure 5:
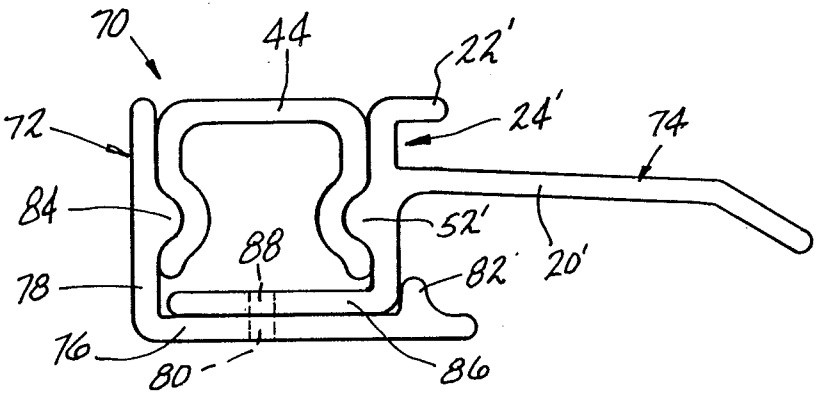
FIG. 5 illustrates an end terminaton connector in accordance with the present invention.

With reference to FIG. 5, a special end termination connector 70 is illustrated which is used to fasten end panel members to a support structure. The termination connector 70 comprises a substantially L-shaped edge member 72 and an end panel retention member 74. The substantially L-shaped member 72 has a base portion 76 and a web portion 78. The base portion 76 is similar to the base portion 16 of retention member 12 in that it has an aperture 80 through which a fastener can pass and an upraised stop portion 82. The web portion 78 is similar to the web portion 18 in that it has substantially semi-cylindrical portion 84.

The panel retention member 74 is identical in construction to the member 14. It has a base portion 86 sized to fit between the upraised stop portion 82 and the web portion 78. The base 86 includes an aperture 88 for receiving a fastener. When the members 72 and 74 are in overlapping relation, aperture 88 is aligned with aperture 80.

The connector 70 may also include a cap 44 for sealing the gap between member 72 and 74.

To form a wall having a plurality of panels 28 substantially lying in a common plane, the following method is employed. The walls of the flanges 20, 20', 22, 22' and the portions of the webs 18, 18' defining the recesses 24 and 24' of the various connectors are sprayed with an adhesive. The edge portions of the panel members to be inserted into the recesses are also sprayed with an adhesive. Preferably after adhesive has become tacky, each panel edge portion is inserted within the recess of a respective connector. Intermediate panel members are thus permanently joined to panel retention members 12 and/or 14. End panel members are permanently joined along one edge to retention member 74 and along the opposite edge to either retention member 12 or 14.

After the adhesive has set, a first panel-connector assembly is mounted to a support structure. For example, edge member 72 is positioned against support 58 and panel retention member 74 width edge panel 28 fastened thereto is positioned against support 58 and panel retention member 74 with edge panel 28 fastened thereto is positioned in overlapping relationship with member 72. A fastener 90 is then used to fasten members 72 and 74 to support structure 58. Thereafter, retention member 12 attached to the opposite edge of panel 28 is positioned against support 54. A second panel member 28' is installed by positioning a retention member 14 in overlapping relationship with the retention member 12 and fastening the members 12 and 14 to the support structure via a fastener 40 passing through the aligned apertures 36, 36'. The method is then continued until each panel member forming the wall has been similarly installed with the opposite end panel 28' being fastened to support 60 by its terminal connector 70.

If needed, a shim 56 may be placed intermediate one of the connectors 10 or 70 and its respective support.

A sealant 34 such as a silicone sealant may be inserted into each space 35 between an angled flange edge portion 30 and a surface 32 of a panel 28 either before or after the panel members are installed, preferably before. The sealant 34 serves to keep moisture, dust and other environmental hazards out of the recesses 24, 24'.

If desired, a sealing means such as a gasket not shown or the cap 44 may be inserted into each gap 42 after the panel members have been installed. For exterior applications, the gasket or the cap 44 may serve as a weather seal. For both exterior and interior applications, the cap 44 may be used to enhance the appearance of the wall.

As can be seen from the above description, the connector of the present invention is relatively simple to install and use. As a result, the system and method for forming a substantially planar wall is simple to use.

The connector of the present invention may be used with a wide variety of panels having a wide variety of finishes without damaging or destroying the finish. As a result, walls formed in accordance with the present invention have an aesthetically pleasing appearance.

It is apparent that there has been provided in accordance with this invention a non-foldable composite attachment system which fully satisfies the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A system for forming a substantially planar wall structure which comprises:
   - at least one support member;
   - at least two panel members lying substantially in a common plane;
   - at least one connector for joining adjacent ones of said panel members;
   - each said connector being joined to said at least one support member and comprising two separable panel retention members in an overlapping relationship; and
   - each said panel retention member being independent of said panel members and having an integral recess for receiving an edge portion of one of said adjacent panel members.

2. A system according to claim 1 which further comprises adhesive material for fixing an edge portion of said panel in each said recess.

3. A system according to claim 1 further comprising a plurality of panel members and a plurality of connectors with each connector being positioned between adjacent ones of said panel members.

4. A system according to claim 1 further comprising at least one termination connector for joining an end panel member to a support structure.

5. A system according to claim 4 wherein said at least one termination connector includes an edge member and an end panel retention member in overlapping relationship with said edge member.

6. A system according to claim 1 wherein each said panel retention member has a base portion, a web portion extending from said base portion, and two substantially parallel flanges extending from said web portion and defining said integral recess, each said flange lying outwardly of and overlapping an exterior surface of said panel member received by said recess.

7. A system according to claim 6 wherein said two flanges are non-coextensive.

8. A system according to claim 6 which further comprises:
   - one of said recess defining flanges on each of said retention members including an angled edge portion located adjacent to an exterior surface of said panel member inserted within said recess; and
   - a sealant inserted between said angled edge portion and said exterior surface of said panel member.

9. A system according to claim 6 which further comprises:

each said base portion having an aperture;

said apertures being aligned when said two panel retention members are in said overlapping relationship; and a fastener passing through said aligned apertures for joining said at least one connector to said at least one support member.

10. A system according to claim 6 which further comprises:

said web portions of said panel retention members defining a gap when said panel retention members are in said overlapping relationship;

cap means for sealing said gap; and means on each said web portion for locking said sealing means in position.

11. A system according to claim 10 wherein said locking means on each said web portion comprises a substantially semi-cylindrical surface portion for engaging and mating with a substantially semi-cylindrical recess in a sidewall of said sealing means.

12. A system according to claim 10 wherein each said panel retention member comprises a metal extrusion and said cap means comprises a plastic strip insert.

13. A system for forming a substantially planar wall structure comprising:

at least one support member;

at least two panel members lying substantially in a common plane, at least one connector for joining adjacent ones of said panel members;

each said connector being joined to said at least one support member and comprising two separable panel retention members in an overlapping relationship;

each said panel retention member having an integral recess for receiving an edge portion of one of said adjacent panel members;

each said panel retention member comprising a base portion, a web portion extending from said base portion and two substantially parallel flanges extending from said web portion and defining said integral recess;

the base portion of a lower one of said panel retention members affixed to said at least one support member having a raised portion; and the base portion of an upper, overlapping one of said panel retention members being sized to fit between said raised base portion and said web portion of said lower panel retention member.

14. A connector for joining two adjacent panels so that said panels substantially lie in a common plane, said connector comprising:

two panel retention members in an overlapping relationship;

each said panel retention member including a base portion, a web portion extending substantially perpendicular to said base portion, and two spaced apart flange members extending from one surface of said web portion;

said two flange members extending substantially parallel to each other and to said base portion and defining a recess therebetween for receiving an edge of one of said panels; and one of said flange members on each said retention member having an angled edge portion for receiving a sealant material lying adjacent to and outwardly of an exterior surface of a panel member inserted within said recess.

15. A connector according to claim 14 wherein said two flange members defining said recess are non-coextensive.

16. A connector according to claim 14 wherein one of said retention members has a raised base portion and the other of said retention members has a base portion sized to fit between said raised base portion and said web portion of said one retention member.

17. A connector according to claim 14 wherein each said base portion has an aperture for receiving a fastener and said apertures are aligned when said retention members are in said overlapping relationship.

18. A connector according to claim 14 wherein said web portions of said panel retention members define a gap when said retention members are in said overlapping relationship and said connector further includes cap means for sealing said gap.

19. A connector according to claim 18 wherein said cap means has two sidewalls, each said sidewall has a substantially semi-cylindrical recess therein, and each said web portion has a substantially semi-cylindrical mating portion for engaging one of said semi-cylindrical recesses and for positively locking said cap means to said web portions.

20. A connector according to claim 18 wherein said panel retention members are formed by metal extrusions and said cap means is formed from a plastic material.

21. A method for forming a substantially planar wall structure which comprises:

providing at least two panel members;

providing at least one connector comprising two panel retention members adapted to be positioned in a overlapping relationship, each said retention member having a base portion, a web portion and two substantially parallel flanges extending from said web portion and defining with said web portion a recess for receiving an edge portion of one of said panels;

applying an adhesive to portions of said flanges and said web portion defining each said recess and to edge portions of said panel members;

inserting an edge portion of each said panel member into said recess in a respective one of said retention members so that said flanges lie outwardly of and in abutment with exterior surfaces of said panel member edge portion; and forming said wall by placing each said panel member in a desired position and fastening each said retention member to a respective support structure.

22. A method according to claim 21 which further comprises applying a sealant material between an angled edge portion of one of said flanges defining each said recess and an exterior surface of said panel member within said recess.

23. A method according to claim 21 which further comprises providing a cap means for sealing a gap between said retention members in said overlapping relationship and positively engaging said cap means with said retention members to hold said cap menas in position.

* * * * *